US005263316A

United States Patent [19]

Shekleton

[11] Patent Number: 5,263,316

[45] Date of Patent: Nov. 23, 1993

[54] TURBINE ENGINE WITH AIRBLAST INJECTION

[75] Inventor: Jack R. Shekleton, San Diego, Calif.

[73] Assignee: Sundstrand Corporation, Rockford, Ill.

[21] Appl. No.: 455,508

[22] Filed: Dec. 21, 1989

[51] Int. Cl.[5] ..... F02G 1/00

[52] U.S. Cl. ..... 60/39.36; 60/743; 60/760

[58] Field of Search ..... 60/39.36, 743, 746, 60/755, 760

[56] References Cited

U.S. PATENT DOCUMENTS

| | | | |
|---|---|---|---|
| 2,706,520 | 4/1955 | Chandler | 60/739 |
| 2,999,359 | 9/1961 | Murray . | |
| 3,099,134 | 7/1963 | Calder et al. | 60/752 |
| 3,355,884 | 12/1967 | Poucher et al. | 60/743 |
| 3,483,699 | 12/1969 | Harvey . | |
| 3,613,360 | 10/1971 | Howes | 60/39.36 |
| 3,834,627 | 9/1974 | Watkins . | |
| 3,899,881 | 8/1975 | Arvin et al. . | |
| 3,903,692 | 9/1975 | Croker . | |
| 4,151,709 | 5/1979 | Mellonian et al. | 60/39.36 |
| 4,437,314 | 3/1984 | Collin . | |
| 4,561,257 | 12/1985 | Kwan et al. | 60/737 |
| 4,928,479 | 5/1990 | Shekleton et al. | 60/39.36 |

*Primary Examiner*—Richard A. Bertsch
*Assistant Examiner*—T. Thorpe
*Attorney, Agent, or Firm*—Wood, Phillips, VanSanten, Hoffman & Ertel

[57] ABSTRACT

Improved fuel atomization for turbine engines utilizing high viscosity fuels is accomplished in an engine having an annular combustor (26) by providing an air injector (52) which produces an air stream (50) generally tangentially directed into the combustor (26) to intersect a fuel spray or film (46) also generally tangentially directed into the combustor (26) by a fuel injector (48) to atomize fuel for ignition by an igniter (60) in an annular outer wall (34) of the combustor (26).

26 Claims, 1 Drawing Sheet

TURBINE ENGINE WITH AIRBLAST INJECTION

FIELD OF THE INVENTION

This invention relates to turbine engines and, more particularly, to turbine engines having fuel atomizing capability for high viscosity fuels.

BACKGROUND OF THE INVENTION

Turbine engines often utilize volatile, non-viscous fuels which are very easy to burn. For instance, fuel viscosities even at very low temperatures are typically on the order of 12 centistokes which is believed to be common for the gas turbine industry. However, for some applications, it is necessary to use high density fuels.

By way of example, it may be desirable to use relatively non-volatile, high viscosity JP10 fuel for certain missile applications This fuel, while expensive, nevertheless does provide approximately a twenty percent range increase due primarily to its high density in contrast to low density, volatile, non-viscous fuels such as JP4. But because of the relatively non-volatile nature of JP10, it is usually found to be quite difficult to evaporate for combustion.

Moreover, JP10 is known to have a viscosity up to on the order of approximately 37 centistokes which presents a significant problem. Specifically, this means that fuel atomization by conventional means is difficult if not impossible. As an additional problem, the combustor volume may be very small making acceptable combustion difficult even with volatile, non-viscous fuels.

For this reason, high viscosity fuels such as JP10 present a formidable added problem in applications of the type contemplated herein. This is even more the case since the solution must, for practical reasons, be simple and inexpensive. In this connection, it is known to be desirable to be able to reduce the number and complexity of fuel injectors.

Typically, the objective is to get good mixing of fuel and air not only to assure efficient space utilization with a minimal number of fuel injectors but also to assure optimal combustion. Optimal combustion requires a uniform circumferential air-fuel ratio near stoichiometric. Without good mixing circumferentially, there may be either fuel rich or fuel lean conditions which may well significantly degrade the capability of achieving efficient combustion.

For this reason, and in particular for a small combustor with a minimal available volume, good circumferential mixing of fuel and air is essential.

The present invention is directed to overcoming one or more of the stated problems and achieving the resulting objects.

SUMMARY OF THE INVENTION

It is the principal object of the invention to provide a new and improved turbine engine. More specifically, it is an object of the invention to provide a new and improved fuel injection system for a turbine engine which provides excellent fuel atomization even with high viscosity fuels. It is a further object of the invention to provide an air injector for producing an air stream to intersect a fuel spray or film of a fuel injector.

An exemplary embodiment of the invention achieves the foregoing objects in a turbine engine including a rotary compressor and a turbine wheel coupled to the compressor to drive same. An annular nozzle is proximate the turbine wheel for directing gases of combustion at the turbine wheel and an annular combustor defining an annular combustor space is disposed about the turbine wheel and is in fluid communication with both the compressor and the nozzle. In addition, the combustor includes an annular outer wall having at least one igniter mounted therein, and it receives fuel from a source and air from the compressor to combust same to generate the gases of combustion.

Further, the turbine engine includes means for injecting fuel from the source into the combustor in a manner producing a fuel spray or film therewithin. It also includes means for injecting air from the compressor into the combustor in a manner producing an air stream within the combustor. With this arrangement, the air injecting means is positioned such that the air stream intersects the fuel spray or film of the fuel injecting means.

In a preferred embodiment, the fuel injecting means comprises at least one fuel injector and the air injecting means comprises at least one air injector. The fuel and air injectors are advantageously mounted in the annular outer wall of the combustor. In addition, the fuel and air injectors are mounted in circumferentially spaced relation with each of the fuel injectors being mounted downstream of one of the air injectors.

Preferably, the fuel sprays or films and the air streams are generally tangentially directed into the combustor. In particular, the fuel sprays or films and the air streams are advantageously directed into the combustor at different angles in order to assure that at least one of the air streams intersects each of the fuel sprays or films. In a highly preferred embodiment, the air injectors are greater in number than the fuel injectors and, preferably, a multiple thereof.

Still further, each of the fuel injectors preferably includes a generally radially opening discharge orifice and an impingement surface within the combustor in the path of fuel discharged from the orifice and at an angle thereto so as to produce the fuel spray or film. For this purpose, each of the impingement surfaces is preferably defined by a finger facing the radially opening discharge orifice at an acute angle. In one form of the invention, each of the fuel injectors includes a barrel terminating in one of the radially opening discharge orifices and in another form of the invention each of the fuel injectors includes a fuel orifice in the annular outer wall which is fed by a fuel manifold radially outwardly thereof.

Other objects, advantages and features of the present invention will become apparent from a consideration of the following specification taken in conjunction with the accompanying drawings.

DETAILED DESCRIPTION OF THE PREFERRED EMBODIMENTS

Figure 1:
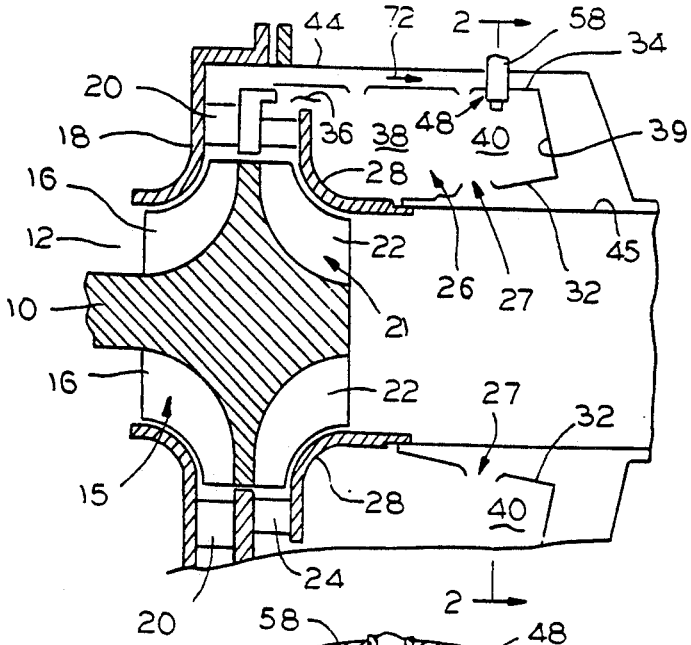
FIG. 1 is a somewhat schematic, sectional view of a turbine engine embodying the invention.

An exemplary embodiment of a turbine engine made according to the invention is illustrated in the drawings in the form of a radial flow, air breathing gas turbine. However, the invention is not limited to radial flow turbines and may have applicability to any form of air breathing turbine having an annular combustor.

As will be appreciated by referring to commonly owned, copending patent applications, U.S. Ser. Nos. 283,080 now U.S. Pat. No. 4,989,404 and 291,057, now U.S. Pat. No. 5,027,603 filed Dec. 12, 1988 and Dec. 28, 1988, respectively, the turbine engine includes a rotary shaft 10 journaled by bearings (not shown). As shown in FIG. 1, the turbine engine is configured such that adjacent one end of the shaft 10 is an inlet area 12. The shaft 10 mounts a rotor, generally designated 14, which may be of conventional construction. Still referring to FIG. 1, the turbine engine also includes a compressor section, generally designated 15, having a plurality of compressor blades 16 adjacent the inlet 12. A compressor shroud 18 is provided adjacent the compressor blades 16 and just radially outwardly of the radial outward extremities of the compressor blades 16 is a conventional diffuser 20.

Oppositely of the compressor blades 16, the rotor 14 includes a turbine wheel, generally designated 21, including a plurality of turbine blades 22. As shown in FIG. 1, an annular nozzle 24 is provided just radially outwardly of the turbine blades 22 to receive hot gases of combustion along with a dilution air from an annular combustor, generally designated 26. The compressor 15 including the blades 16, the shroud 18, and the diffuser 20 delivers compressed air to the annular combustor 26, and via dilution air passages 27, to the nozzle 24 along with the gases of combustion. Still referring to FIG. 1, the hot gases of combustion from the combustor 26 are directed via the nozzle 24 against the blades 22 to cause rotation of the rotor 14 and thus the shaft 10. Of course, it will be appreciated that the shaft 10 may be coupled to some sort of apparatus requiring the performance of useful work.

A turbine blade shroud 28 is interfitted with the combustor 26 to close off the flow path from the nozzle 24 and confine the expanding gas to the area of the turbine blades 22. The combustor 26 has a generally annular inner wall 32, and a generally annular outer wall 34. The two are generally concentric with each other and with the rotational axis of the shaft 10 and merge to a necked down area 36 which extends to the nozzle 24 and serves as an outlet from an interior annulus 38 defined by the space between the walls 32 and 34 of the combustor 26. A third wall 39, generally concentric with the walls 32 and 34, extends generally radially to interconnect the walls 32 and 34 and to further define the annulus 38.

Opposite the outlet or necked down area 36 and adjacent the wall 39, the interior annulus 38 of the combustor 26 includes a primary combustion zone 40 in which the burning of fuel primarily occurs. The primary combustion zone 40 is an annulus or annular space defined by the generally annular inner wall 32, the generally annular outer wall 34, and the radial wall 39 while other combustion may, in some instances, occur downstream from the primary combustion zone 40 in the direction of the outlet or necked down area 36. As mentioned earlier, provision is made for the injection of dilution air through the passages 27 into the combustor 26 to cool the gases of combustion to a temperature suitable for application to the turbine blades 22 via the nozzle 24.

A further annular wall or case 44 is generally concentric to the walls 32 and 34 and is located radially outward of the latter. Similarly, a radially inwardly spaced inner annular wall 45 inside the wall 32 is provided and together with the wall 44 provides a plenum surrounding the combustor 26. The wall 44 extends to the outlet of the diffuser 20 and thus serves to contain and direct compressed air from the compressor system to the combustor 26.

Figure 2:
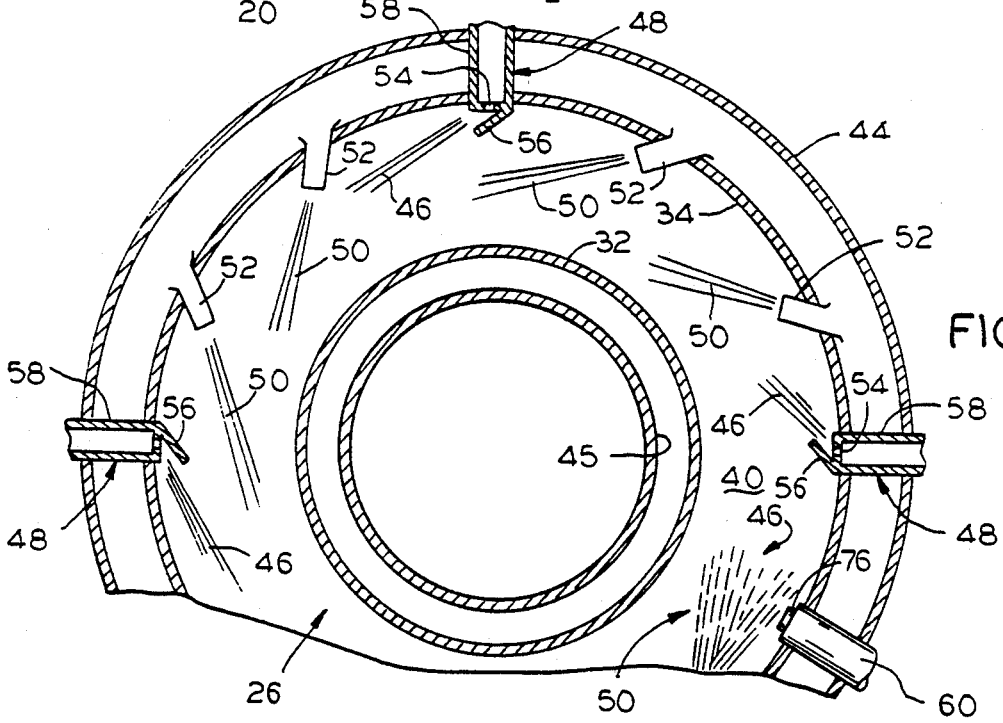
FIG. 2 is a sectional view taken approximately along the lines 2—2 of FIG. 1 and illustrating a first embodiment.
Figure 3:
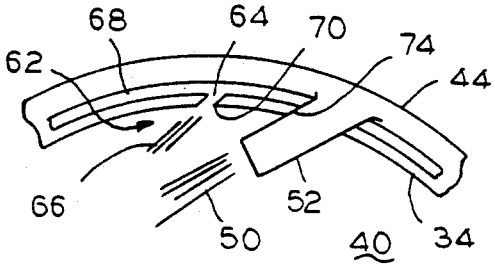
FIG. 3 is a sectional view similar to FIG. 2 but illustrating another embodiment of the invention.

As seen in FIGS. 1 through 3, means are provided for injecting fuel from a source into the combustor 26 in a manner producing a fuel spray or film such as 46 within the combustor 26. The fuel injecting means comprises at least one and preferably a plurality of fuel injectors 48. Similarly, means are provided for injecting air from the compressor 15 into the combustor 26 in a manner producing an air stream 50 within the combustor 26.

In this connection, the air injecting means comprises at least one and preferably a plurality of air injectors 52 The fuel and air injectors 48 and 52, respectively, are mounted in and, thus, integral with the annular outer wall 34 of the combustor 26. As mounted, the air injectors 52 are positioned such that the air stream 50 intersects the fuel spray or film 46 of the fuel injectors 48.

Referring specifically to FIG. 2, the fuel and air injectors 48 and 52, respectively, are mounted in circumferentially spaced relation It will, of course, there be clear that the fuel sprays or films 48 as well as the air streams 50 are generally tangentially directed into the combustor 26, although at a different angle in order to accommodate intersection of the air streams 50 with the fuel sprays or films 46. More specifically, the fuel injectors 48 are each mounted just downstream of one of the air injectors 52 to ensure intersection of at least one of the air streams 50 with each of the fuel sprays or films 46.

Still referring to FIG. 2, the fuel injectors 48 each include a generally radially opening discharge orifice 54 and an impingement surface 56 within the combustor 26 in the path of fuel discharged from the orifice 54 and at an angle thereto so as to produce the fuel spray or film 46. More specifically, each of the impingement surfaces 56 is defined by a finger facing the radially opening discharge orifice 54 at an acute angle whereby the fuel spray or film 46 associated therewith is generally tangentially directed into the combustion space 40 at a different angle than the air streams 50. As clearly shown, the fuel injectors 48 each include a barrel 58 terminating in one of the radially opening discharge orifices 54 such that fuel is discharged therefrom at an acute angle to the impingement surface 56 to cause the fuel spray or film 46 to be generally tangentially directed into the combustion space 40.

Still referring to FIG. 2, it will be seen that an igniter 60 is suitably mounted in the annular outer wall 34 of the annular combustor 26. Also, the igniter 60 is positioned to intercept the fuel spray or film 46 from at least one of the fuel injectors 48 after that fuel spray or film 46 has been intersected by the air stream 50 to cause more complete atomization thereof. In this manner, the annular combustor 26 is far more efficient inasmuch as substantially complete atomization occurs even for high viscosity fuels.

Referring now to FIG. 3, a somewhat different fuel injecting means has been illustrated which includes fuel injecting means comprising a plurality of fuel injectors generally designated 62. Each of the fuel injectors 62 includes a fuel orifice 64 in the annular outer wall 34 such that fuel is discharged from the fuel orifice 64 at an acute angle to the impingement surface to cause the fuel spray or film 66 to be generally tangentially directed into the combustion space 40. For this purpose, the fuel injecting means also includes a fuel manifold 68 radially outwardly of the annular outer wall 34 in communication with each of the fuel orifices 64.

As before, the fuel injectors 62 each include an impingement surface 70 within the combustor 26 in the path of fuel discharged from the orifice 64. This impingement surface 70 may again comprise a finger facing the orifice 64 which finger may be integral with the annular outer wall 34 and disposed at an acute angle to the path of fuel discharged from the orifice 64 so as to produce the fuel spray or film 66. In this embodiment, the fuel injectors 62 are very inexpensive yet effective to cause substantially complete atomization of even high viscosity fuels.

As again shown in FIG. 3, the fuel sprays or films 66 and the air streams 50 are directed into the combustor 26 at different angles. Thus, while both the fuel sprays or films 66 and the air streams 50 are generally tangentially directed into the combustion space 40, the fuel sprays or films 66 will each be directed such that at least one of the air streams intersects it to enhance atomization. If desired, the air injector 52 could be arranged such that more than one of the air streams 50 intersects any given fuel spray or film 66.

Figure 4:
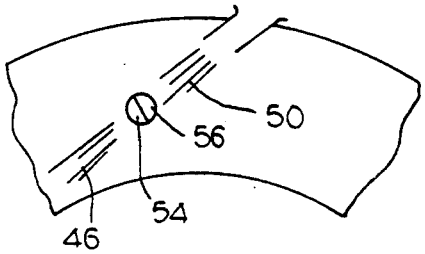
FIG. 4 is a sectional view similar to FIG. 2 but illustrating yet another embodiment of the invention.

Referring now to FIG. 4, a somewhat different relative arrangement and orientation of the fuel injectors 48 and air injectors 52 has been illustrated. In particular, it will be seen that, while the air injectors 52 are still disposed in the same position in the annular outer wall 34 as with the embodiments illustrated in FIGS. 2 and 3, the fuel injectors 48 are circumferentially arranged about the radial wall 39 comprising the combustor dome. Nevertheless, due to the orientation of the impingement surfaces 56, at least one of the air streams 50 will still intersect with each of the fuel sprays or films 46 to achieve improved fuel atomization.

In practice, it is highly desirable to provide the air injectors 52 in greater numbers than the fuel injectors 48 or 62. It has, in fact, been found desirable for the number of air injectors 52 relative to the fuel injectors 48 or 62 to be determined by the formula $x=ny$ where $x$=number of air injectors, $y$=number of fuel injectors, and $n=2$, 3, etc. In other words, the air injectors 52 preferably are a multiple of the fuel injectors 48 or 62.

In this connection, it has been found through testing that good circumferential mixing of fuel and air is accomplished by increasing the relative number of air injectors 52. This is highly desirable not only for the advantageous mixing of even high viscosity fuels but also because minimizing the number of fuel injectors reduces complexity and expense in the turbine engine. By establishing the number of air injectors 52 as a multiple of the fuel injectors 48 or 62, the design and construction of the turbine engine is greatly facilitated.

As shown in FIGS. 2 and 3, the annular wall or case 44 is radially outwardly of the annular outer wall 34. The annular outer wall 34 and combustor case 44 thus define a compressed air flow path generally designated 72 which extends from the compressor 15 to the combustor 26. In this manner, the air injectors 52 are adapted to receive compressed air from the compressed air flow path 72.

More specifically, the air injectors 52 each include a barrel 74. The barrels 74 each extend generally tangentially of the combustor 26 through the annular outer wall 34 from a point within the plenum which houses the compressed air flow path 72 to a point within the combustion space 40. As will be appreciated, the barrel 74 causes the air stream 50 to take on the attributes of a high velocity air jet.

As will be appreciated by referring to FIG. 2, the igniter 60 has an ignition tip 76 disposed in the combustor annulus 38. As previously mentioned, the tip 76 is in the path of the flat, diverging spray or film 46 from at least one of the fuel injectors 48. In other words, the igniter 60 is positioned so as to intercept the spray or film 46 from one of the fuel injectors 48.

Still referring to FIG. 2, it will be seen that a plurality of circumferentially spaced apart fuel injectors 48 and igniters 60 are preferably provided. The igniters 60 are mounted in the annular outer wall 34 of the combustor 26 as are the fuel injectors 48. In addition, one or a multiple number of air injectors 52 are preferably disposed intermediate each of the fuel injectors 48.

Because the invention employs impingement pressure atomization combined with jet stream atomization, the difficulties associated with achieving good atomization with high viscosity fuels are minimized. It will also be appreciated that fuel injectors 48 and 62 made according to the invention need not be made with the same precision as injectors heretofore used because, unlike some precisely formed orifice or the like, the impingement surfaces 56 and 70 are the instrumentalities that provide the desired initial atomization. When combined with the atomization from the jet air streams 46, a highly efficient low cost turbine engine is achieved.

While in the foregoing there have been set forth preferred embodiments of the invention, it will be appreciated that the invention is only to be limited by the true spirit and scope of the appended claims.

I claim:

1. A turbine engine, comprising:

a rotary compressor;

a turbine wheel coupled to said compressor for driven movement thereof;

an annular combustor defining an annular combustion space disposed about said turbine wheel and in fluid communication with both said compressor and said nozzle, said combustor having at least one igniter mounted therein, said combustor being adapted to receive fuel from a source and air from said compressor and to combust fuel and air in said combustion space to generate said gases of combustion;

impingement pressure fuel injection means for injecting fuel from said source into said combustor in a manner producing fuel spray or film within said combustor; and jet stream atomization means for injecting air from said compressor into said combustor in a manner producing an air stream within said combustor;

said jet stream atomization means being positioned such that said air stream intersects said fuel spray or film of said impingement pressure fuel injection means at an acute angle to atomize the fuel.

2. The turbine engine as defined in claim 1 wherein said combustor has an annular outer wall, said impingement pressure fuel injection means comprising at least one fuel injector and said jet stream atomization means comprising at least one air injector, said fuel and air injectors being mounted in said annular outer wall of said combustor.

3. The turbine engine as defined in claim 2 wherein said fuel and air injectors are mounted in circumferentially spaced relation, said fuel spray or film and said air stream being generally tangentially directed into said combustor, each of said fuel injectors being mounted downstream of one of said air injectors.

4. The turbine engine as defined in claim 2 wherein each of said fuel injectors includes a generally radially opening discharge orifice and an impingement surface within said combustor in the path of fuel discharged from said orifice and at an angle thereto so as to produce said fuel spray or film.

5. The turbine engine as defined in claim 4 wherein each of said fuel sprays or films is generally tangentially directed into said combustion space, and said igniter is mounted in said annular outer wall of said combustor and positioned to intercept said fuel spray or film from at least one of said fuel injectors.

6. The turbine engine as defined in claim 4 wherein each of said impingement surfaces is defined by a finger facing said radially opening discharge orifice at an acute angle wherein said fuel spray or film is generally tangentially directed into said combustion space at a different angle than said air stream.

7. The turbine engine as defined in claim 6 wherein each of said fuel injectors includes a barrel terminating in one of said radially opening discharge orifices with fuel being discharged therefrom at an acute angle to said impingement surface to cause said fuel spray or film to be generally tangentially directed into said combustion space.

8. The turbine engine as defined in claim 6 wherein each of said fuel injectors includes a fuel orifice in said annular outer wall such that fuel is discharged from said fuel orifice at an acute angle to said impingement surface to cause said fuel spray or film to be generally tangentially directed into said combustion space.

9. The turbine engine as defined in claim 8 including a fuel manifold radially outwardly of said annular outer wall in communication with each of said fuel orifices.

10. A turbine engine, comprising:

a rotary compressor;

a turbine wheel coupled to said compressor for driven movement thereof;

an annular nozzle proximate said turbine wheel for directing gases of combustion thereat;

an annular combustor defining an annular combustion space disposed about said turbine wheel and in fluid communication with both said compressor and said nozzle, said combustor having an annular outer wall with at least one igniter mounted therein, said combustor being adapted to receive fuel from a source and air from said compressor and to combust fuel and air in said combustion space to generate said gases of combustion;

a plurality of impingement pressure atomization fuel injectors for injecting fuel from said source into said combustor, each of said fuel injectors including means for producing a fuel spray or film, said fuel sprays or films being generally tangentially directed into said combustor; and a plurality of jet stream atomization air injectors for injecting air from said compressor into said combustor, each of said air injectors including means for producing an air stream, said air stream being generally tangentially directed into said combustor;

said air injectors means being positioned such that at least one of said air streams intersects each of said fuel sprays or films of said fuel injectors at an acute angle to atomize the fuel.

11. The turbine engine as defined in claim 10 wherein said fuel and air injectors are mounted in said annular wall in circumferentially spaced relation, said fuel sprays or films and said air streams being directed into said combustor at different angles, each of said fuel injectors being mounted downstream of one of said air injectors.

12. The turbine engine as defined in claim 10 wherein each of said fuel injectors includes a generally radially opening discharge orifice and an impingement surface within said combustor in the path of fuel discharged from said orifice and at an angle thereto so as to produce one of said fuel sprays or films.

13. The turbine engine as defined in claim 10 wherein said igniter mounted in said annular outer wall of said combustor is positioned to intercept said fuel spray or film from at least one of said fuel injectors after said fuel spray or film has been intersected by at least one of said air streams.

14. The turbine engine as defined in claim 12 wherein each of said impingement surfaces is defined by a finger facing said radially opening discharge orifice at an acute angle wherein said fuel spray or film is generally tangentially directed into said combustion space at a different angle than said air stream.

15. The turbine engine as defined in claim 14 wherein each of said fuel injectors includes a barrel terminating in one of said radially opening discharge orifices with fuel being discharged therefrom at an acute angle to said impingement surface to cause said fuel spray or film to be generally tangentially directed into said combustion space.

16. The turbine engine as defined in claim 14 wherein each of said fuel injectors includes a fuel orifice in said annular outer wall such that fuel is discharged from said fuel orifice at an acute angle to said impingement surface to cause said fuel spray or film to be generally tangentially directed into said combustion space.

17. The turbine engine as defined in claim 16 including a fuel manifold radially outwardly of said annular outer wall in communication with each of said fuel orifices.

18. A turbine engine, comprising:

a rotary compressor;

a turbine wheel coupled to said compressor for driven movement thereof;

an annular nozzle proximate said turbine wheel for directing gases of combustion thereat;

an annular combustor defining an annular combustion space disposed about said turbine wheel and in fluid communication with both said compressor and said nozzle, said combustor having an annular outer wall with at least one igniter mounted therein, said combustor being adapted to receive fuel from a source and air from said compressor and to combust fuel and air in said combustion space to generate said gases of combustion;

a plurality of impingement pressure atomization fuel injectors for injecting fuel from said source into said combustor, each of said fuel injectors including means for producing a fuel spray or film directed generally tangentially into said combustor, each of said fuel injectors being integral with said annular outer wall of said combustor; and a plurality of jet stream atomization air injectors for injecting air from said compressor into said combustor, each of said air injectors including means for producing an air stream directed generally tangentially into said combustor, each of said air injectors being integral with said annular outer wall of said combustor;

said air injectors being greater in number than said fuel injectors;

said air injectors being positioned such that at least one of said air streams intersects each of said fuel sprays or films of said fuel injectors at an acute angle to atomize the fuel.

19. The turbine engine as defined in claim 18 wherein said fuel and air injectors are mounted in said annular wall in circumferentially spaced relation, said fuel sprays or films and said air streams being directed into said combustor at different angles, each of said fuel injectors being mounted downstream of at least one of said air injectors.

20. The turbine engine as defined in claim 18 wherein each of said fuel injectors includes a generally radially opening discharge orifice and an impingement surface within said combustor in the path of fuel discharged from said orifice and at an angle thereto so as to produce one of said fuel sprays or films.

21. The turbine engine as defined in claim 18 wherein said igniter mounted in said annular outer wall of said combustor is positioned to intercept said fuel spray or film from at least one of said fuel injectors after said fuel spray or film has been intersected by at least one of said air streams.

22. The turbine engine as defined in claim 20 wherein each of said impingement surfaces is defined by a finger facing said radially opening discharge orifice at an acute angle wherein said fuel spray or film is generally tangentially directed into said combustion space at a different angle than said air stream.

23. The turbine engine as defined in claim 18 including a combustor case radially outwardly of said annular outer wall, said annular outer wall and said combustor case defining a compressed air flow path from said compressor to said combustor, said air injectors receiving compressed air from said compressed air flow path.

24. The turbine engine as defined in claim 18 wherein each of said air injectors includes a barrel, said barrel extending generally tangentially of said combustor through said annular outer wall from a point within said compressed air flow path to a point within said combustion space, said barrel causing said air stream to comprise a high velocity air jet.

25. The turbine engine as defined in claim 18 wherein the number of said air injectors relative to said fuel injectors is determined by the formula $x=ny$ where $x$=number of air injectors, $y$=number of fuel injectors, and $n=2, 3$, etc.

26. The turbine engine as defined in claim 1 wherein the fuel injection means and atomization means are located in a spaced relationship so that fuel impingement occurs prior to air atomization.

* * * * *